US012312060B2

(12) United States Patent
Hara et al.

(10) Patent No.: US 12,312,060 B2
(45) Date of Patent: May 27, 2025

(54) REMOTE CONTROLLER FOR WATERCRAFT

(71) Applicant: HONDA MOTOR CO., LTD., Tokyo (JP)

(72) Inventors: Hiroaki Hara, Saitama (JP); Mikiya Yatagai, Saitama (JP); Shogo Yoneyama, Saitama (JP); Taiichi Otobe, Saitama (JP); Naoki Aikawa, Saitama (JP); Hidetoshi Kabayama, Saitama (JP); Yoshio Kurahashi, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 497 days.

(21) Appl. No.: 17/957,185

(22) Filed: Sep. 30, 2022

(65) Prior Publication Data

US 2024/0109635 A1 Apr. 4, 2024

(51) Int. Cl.
*B63H 21/21* (2006.01)
*B63H 25/00* (2006.01)

(52) U.S. Cl.
CPC ..... *B63H 21/213* (2013.01); *B63H 25/00* (2013.01)

(58) Field of Classification Search
CPC ..... B63H 21/213; B63H 25/00
See application file for complete search history.

(56) References Cited

U.S. PATENT DOCUMENTS 3,153,945 A * 10/1964 Mitchell ..... B63H 21/213 477/113
3,638,887 A * 2/1972 Thurston ..... B64C 35/008 244/102 SL
6,280,269 B1 * 8/2001 Gaynor ..... B63H 21/213 440/86
2006/0005660 A1 * 1/2006 Rick ..... G05G 1/04 74/523
2015/0253802 A1 9/2015 Ozaki

FOREIGN PATENT DOCUMENTS

JP 2015166225 A 9/2015

* cited by examiner

*Primary Examiner* — Stephen P Avila
(74) *Attorney, Agent, or Firm* — Armstrong Teasdale LLP

(57) ABSTRACT

A remote controller (4) for watercraft (6) includes a rod (21) extending downward from the free end part of a lever along a lengthwise direction thereof, a lock release button (14) slidably provided in the free end part so as to be slidable in a first direction different from the lengthwise direction of the lever, and a conversion mechanism provided between the lock release button and the first end of the rod to covert a movement of the lock release button in the first direction to a movement of the rod in a second direction extending along the lengthwise direction of the lever.

13 Claims, 9 Drawing Sheets

REMOTE CONTROLLER FOR WATERCRAFT

TECHNICAL FIELD

The present invention relates to a remote controller for watercraft.

BACKGROUND ART

Watercraft equipped with a prime mover such as an outboard motor is sometimes provided with a remote controller (remote control device) for remotely controlling the prime mover. For example, in a remote controller for an outboard motor, an operation lever is supported at its base end by a control box provided on the side of the hull so as to be tiltable around a pivot axis extending in the lateral direction.

The operating lever is connected to the transmission device and the throttle lever of the outboard motor via a control wire in such a manner that the outboard motor may be switched between forward, neutral and reverse by tilting the operating level forward tilted position, an upright position, and a rearward tilted position (forward position, neutral position, and reverse position), respectively.

Furthermore, in order to prevent the operating lever from being inadvertently shifted from the neutral position to the forward or reverse position, a mechanism is provided to prohibit the operation of the operating lever. Typically, the free end of the operating lever is provided with a grip extending laterally, and an lock release button (locking button) that can be selectively retracted is provided on the upper side or the lower side of the grip so that the operating lever can be operated to the forward or backward position only when the grip is gripped by the operator and the lock release button is depressed to the retracted position. For example, JP2015-166225A discloses such a remote controller that can be attached to either the left side or the right side of the hull. Such control levers are widely used in ships using an internal combustion engine as a prime mover, but are also used in electric-powered ships which are becoming increasingly popular in recent years.

The operation lever for watercraft equipped with such a conventional lock release button is known to have some issues regarding the operability of the lock release button, and some improvement may be required. Also, the lock release button tends to spoil the external appearance of the operating lever.

SUMMARY OF THE INVENTION

In view of such a problem of the prior art, a primary object of the present invention is to provide a remote controller for watercraft equipped with a lock release button which excels in operability, and provides an improved external appearance. The present invention therefore contributes to enhancement of traffic safety and development of sustainable transport systems.

To achieve such an object, the present invention provides a remote controller (4) for watercraft (6), comprising: a remote controller main body (5) configured to be fixed to a hull (1), a holder (22) fixedly attached to the remote controller main body, a lever (7) having a base end part pivotally attached to the remote controller main body and a free end part (8), the lever being tiltable between in an upright initial position and a tilted operating position; a lock member (31) provided in the base end part of the lever so as to be movable between a lock position for engaging with the holder to prohibit tilting of the lever and a release position for releasing the holder; a rod (21) extending downward from the free end part of the lever along a lengthwise direction of the lever, and having a first end positioned in the free end part and a second end connected to the lock member; a lock release button (14) slidably provided in the free end part so as to be slidable in a first direction different from the lengthwise direction of the lever; and a conversion mechanism provided between the lock release button and the first end of the rod to covert a movement of the lock release button in the first direction to a movement of the rod in a second direction extending along the lengthwise direction of the lever.

Since the direction of operation of the lock release button can be tilted with respect to the vertical direction, and can be ergonomically favorably positioned, the operability of the lock release button can be improved.

Preferably, the free end part of the lever has a laterally extending grip (8), and the lock release button is provided in an obliquely forward position on a lower part of the grip, the first direction being an oblique direction intermediate between downward and forward directions.

Since the lock release button is located on the opposite side of the grip from the line of sight of the user, the lock release button is concealed from the view of the user so that the external appearance of the lever as a whole can be improved.

Preferably, the conversion mechanism consists of a slot cam mechanism which includes a cam member (19) provided integrally with the lock release button, a cam slot (20) formed in the cam member so as to extend in a third direction different from the first direction and the second direction, and a cam pin provided on the first end of the rod so as to engage the slot.

Thus, the first direction can be determined by suitably selecting the third direction along which the cam slot extends. Therefore, the degree of freedom in designing the lock release button can be increased. Preferably, the cam member is formed on the lock release button while the cam pin is formed on the first end of the rod, but the cam member may also be formed on the first end of the rod while the cam pin is formed on the lock release button.

Preferably, the lever includes a lever main body (10) and a lever cover (11) that covers the lever main body, and the lever main body is provided with a recess (70) in an upper end thereof, an opening (50) provided at an obliquely front part of the grip (8) for receiving the lock release button therein, a serration hole (12) provided in a lower end thereof to be fitted on a serration shaft provided on a side of the remote controller main body, and a window hole (54) for mounting the lock guide member therein.

Thus, a space for positioning various functional parts can be created in the lever, and a mechanical strength necessary for the lever can be ensured in a reliable manner. Also, the lever cover can improve the external appearance of the lever.

Preferably, the lever cover includes a palm rest portion that covers the recess from above, and defines an outer surface that slopes upward toward a front when the lever is at the initial position.

When the forward tilting state of the lever corresponds to the operating position, especially the forward position, the palm rest comfortably supports the user's hand when operating the watercraft, and the operability of the lever can be improved.

Preferably, the rod includes a rod upper end part (62) extending substantially vertically downward from the first end of the rod, a rod intermediate part (63) extending downward from a lower end of the rod upper end part with a rearward slant, and a rod lower end part (64) extending substantially downward from a lower end of the rod intermediate part toward the second end of the rod with a rearward offset relative to the rod upper end part.

Thereby, the lock release button can be ergonomically favorably positioned, and the locking member can be reliably actuated.

Preferably, the lever main body is provided with a rod receiving groove (52) extending on a side surface of the lever main body to receive the rod therein.

Thereby, the rod can be favorably positioned while minimizing the decrease in rigidity of the lever main body.

Preferably, the rod receiving groove includes a first groove (52A) opened toward a side corresponding to an extending direction of the grip to receive the rod upper end part therein, and a second groove (52B) opened toward a side opposite to the side corresponding to the extending direction of the grip to receive at least most of the rod intermediate part therein, and the lever main body is provided with a notch (53) passed laterally through between the first groove and the second groove so as to receive a lower part of the rod upper end part and/or an upper part of the rod intermediate part.

Thereby, the rod can be properly positioned while minimizing reduction in the rigidity of the lever main body.

Preferably, the second groove is substantially wider than the first groove.

Thereby, when the rod intermediate part which is inclined with respect to the vertical direction is displaced in the vertical direction, the rod intermediate part is not interfered by the lever main body.

Preferably, a trim switch (15) for receiving a trim up/down operation is provided on a rear side of the upper end part of the lever, and the lever main body is provided with a wire receiving groove (59A) provided on one side thereof to receive an electric wire connected to the trim switch and an annular groove (59B) provided around the serration hole so as to communicate with the wire receiving groove.

Thereby, the wire receiving groove can be provided separately and isolated from the rod receiving groove so that the wire and the rod can be prevented from interfering with each other. Additionally, by receiving the wire in the annular groove, stress on the wire during lever operation can be minimized.

Preferably, the lever main body includes a lock guide member (44) that guides displacement of the lock member (31) in the second direction.

Thereby, the lock member can be displaced between the release position and the lock position by the lock guide member in a stable manner.

Preferably, the lock member includes a main body made of a plate member, and an engagement piece (33) extending substantially orthogonally to a major plane of the main body so as to engage with an engagement slot (23) of the holder in the lock position, and the lock guide member includes a back plate (45) having a sliding surface slidable on a surface of the main body of the lock member on a side of the engaging piece thereof, a pair of slide plates (46) projecting from either side edge of the back plate so as to slidably guide side edges of the main body, and a front plate (47) extending between free ends of the side plates and having a sliding surface slidable with a surface of the main body of the lock member facing away from the engagement piece thereof, a lower edge of the back plate being higher than an upper edge of the front plate by a distance slightly greater than a vertical direction of the engagement piece.

Thereby, the engaging piece of the locking member can be inserted into an insertion hole (48) defined by the lower edge of the back plate along the upper edge of the front plate. Then, by lowering the lock member in the space defined by the back plate, the front plate and the side plates of the lock guide member, the lock member is positioned so as to be vertically movable between the lock position and the released position in a stable manner. Thus, the lock member can be installed in the lock guide member with ease without requiring any tool.

Preferably, an upper portion of the main body of the engaging piece includes a thick wall portion to define a shoulder surface facing downward, and the lock position is defined by abutting of the shoulder surface against an upper surface of the front plate of the lock guide member.

Thereby, the lock position of the lock member can be defined in a stable manner.

Thus, the present invention provides a remote controller for watercraft equipped with a lock release button which excels in operability, and provides an improved external appearance.

BRIEF DESCRIPTION OF THE DRAWING(S)

DESCRIPTION OF THE PREFERRED EMBODIMENT(S)

Figure 1:
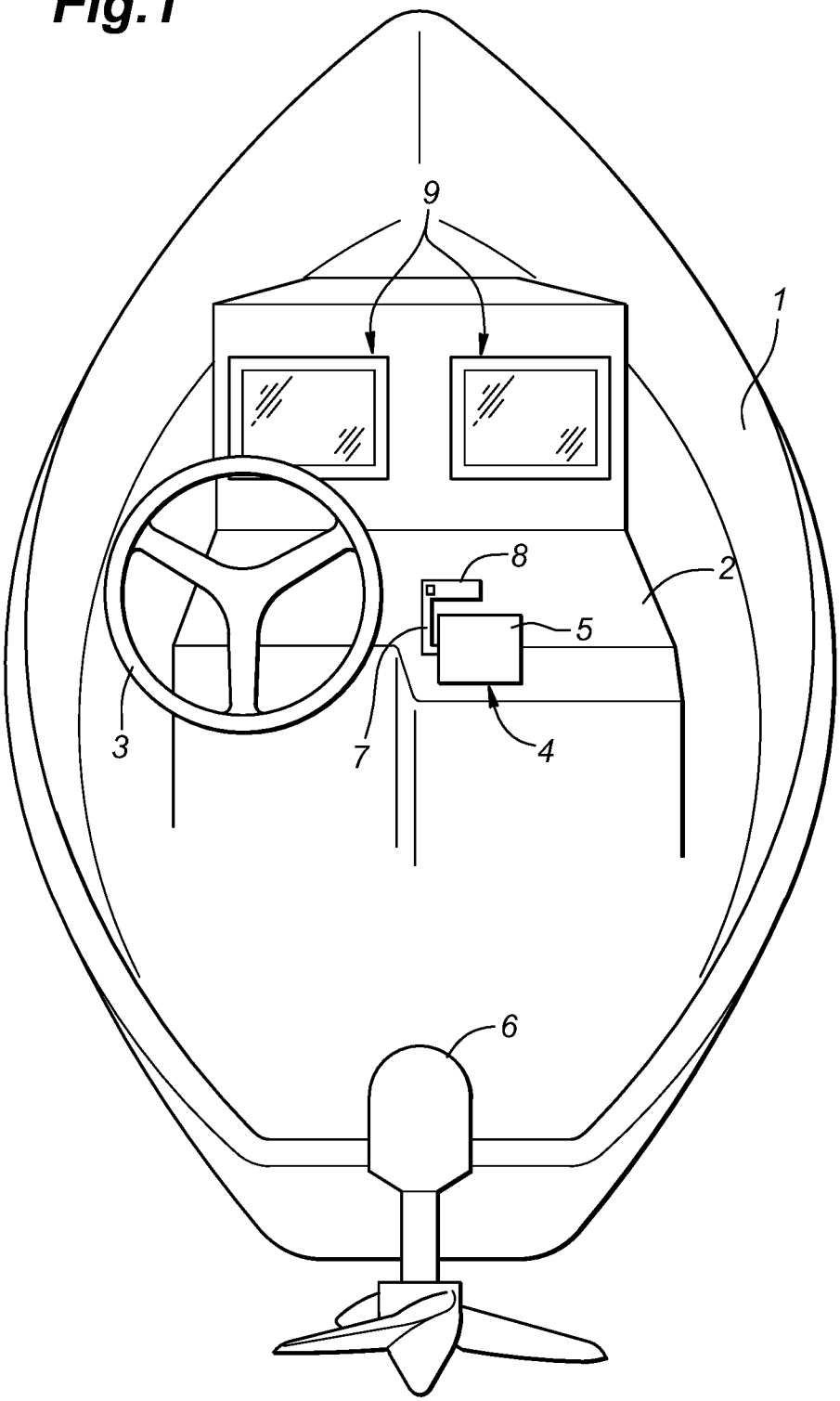
FIG. 1 is a schematic view of an outboard boat fitted with a remote controller according to the present invention.

The remote controller 4 according to an embodiment of the present invention will be described in the following with reference to the appended drawings. FIG. 1 shows a boat to which the present invention is applied. A hull 1 of this boat is provided with an outboard motor 6 at the rear end of the hull 1, and an operation console 2 positioned at the center or in a front part of the hull 1 and provided with equipment necessary for operating the boat. The console 2 is provided with a remote controller 4 for controlling the output and forward/backward movement of the outboard motor 6, and a steering wheel 3 for steering the boat. Further, the operation console 2 is provided with a display device 9 for displaying the speed and position information of the boat.

The remote controller 4 includes a remote controller main body 5 fixed to the operation console 2 and a lever 7 provided at the left end of the remote controller main body 5 so as to be tiltable about a laterally extending pivot axis. The lever 7 has a grip 8 extending rightward from the upper end thereof.

Figure 2:
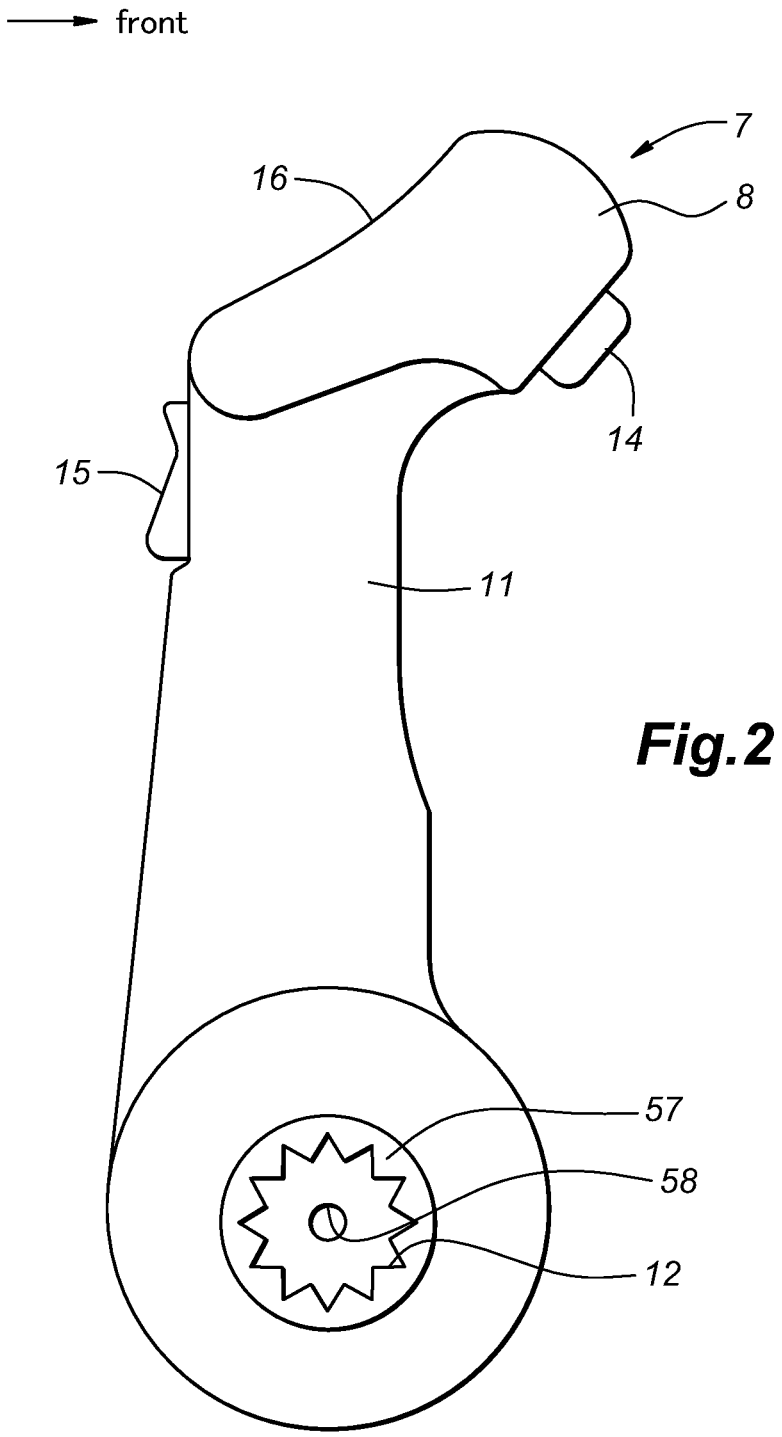
FIG. 2 is a right side view of a lever of the remote controller according to an embodiment of the present invention.

As shown in FIG. 2, the lever 7 assumes a vertical position in the neutral position as will be described later. The following description will be based on the assumption that the lever 7 is in the vertical or upright position unless otherwise noted. The upper surface of the grip 8 forms a palm rest 16 which is inclined by extending forward and upward. At the lower front end of the grip 8, a lock release button 14 is provided so as to be retracted substantially perpendicularly to the surface of the palm rest 16, or in other words in an oblique direction intermediate between the downward direction and the forward direction. A trim switch 15 for receiving tilt up/down and trim up/down operations of the outboard motor 6 is provided on the rear surface of the upper end part of the lever 7. The lower end of the lever 7 is provided with a serration hole 12 opening rightward.

Figure 3:
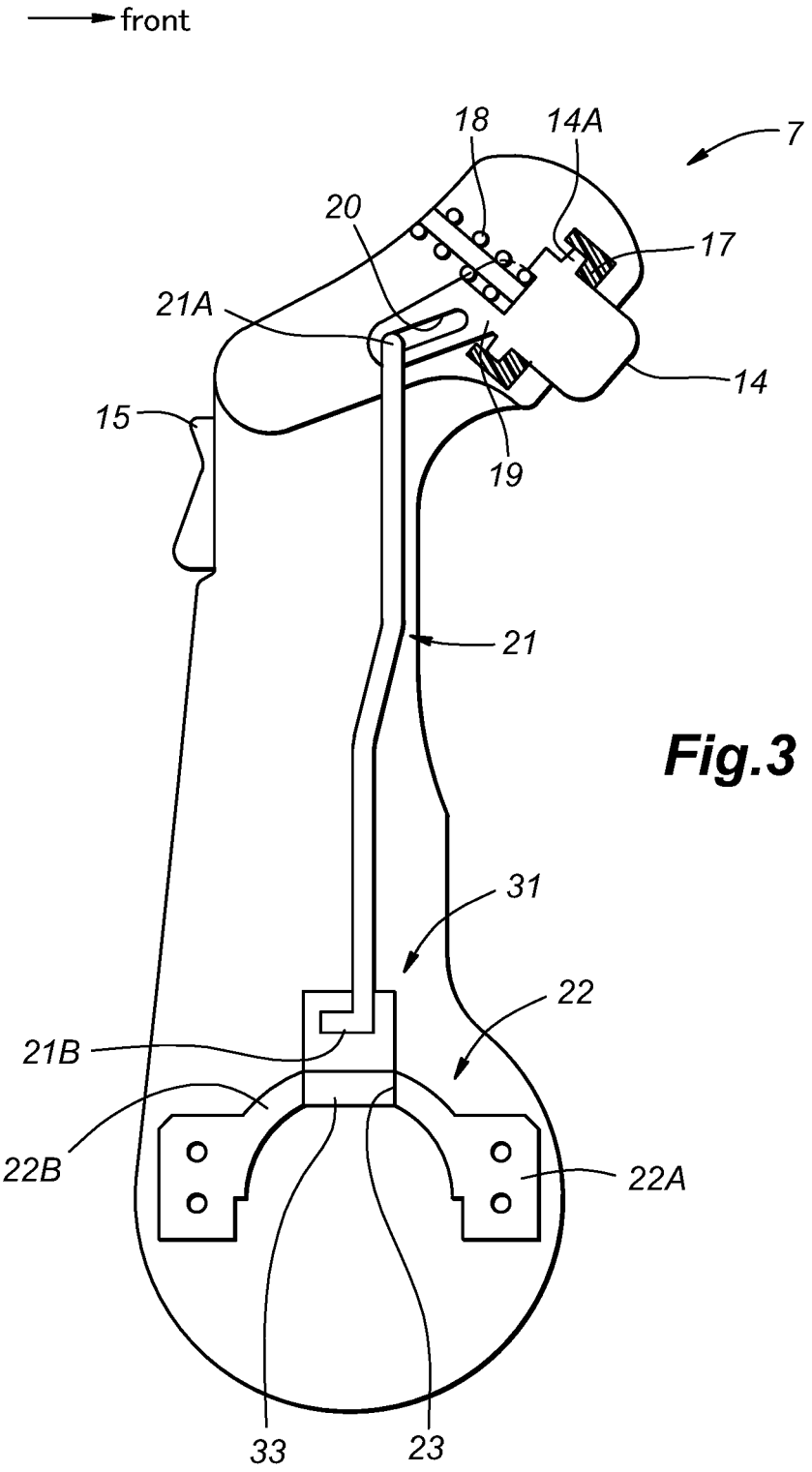
FIG. 3 is a schematic side view showing a functional internal structure of the lever.

FIG. 3 shows the functional internal structure of the lever 7. The lever 7 is provided with a linear guide 17 that guides the lock release button 14 in a forward downward direction, i.e., a first direction, so as to be linearly displaceable, and a compression coil spring 18 that urges the lock release button 14 in a protruding direction. The lock release button 14 is provided with a stopper 14A that cooperates with an abutting surface on the side of the lever 7 to restrict the protruding limit of the lock release button 14.

A cam plate 19 is integrally connected or formed to the inner end of the lock release button 14 so as to extend toward the inside of the lever 7. The lock release button 14 has a lateral length that occupies most of the lateral length of the grip 8, and the cam plate 19 extends from the left end of the lock release button 14 toward the inside of the lever 7. The cam plate 19 is provided with a slot 20 extending substantially parallel to the surface of the palm rest 16, or in other words, extending in a third direction which is directed forward with an upward inclination. The front end of the slot 20 is located higher than the rear end of the slot 20.

A rod 21 extending substantially vertically is positioned inside the lever 7, and the upper end thereof or the first end 21A is bent laterally and received in the slot 20. A lock member 31 is attached to the lower end of the rod 21 or the second end 21B. The lock member 31 can be selectively inserted into an engagement slot 23 formed in the holder 22 fixedly attached to the remote controller main body 5, as will be described later.

Figure 4:
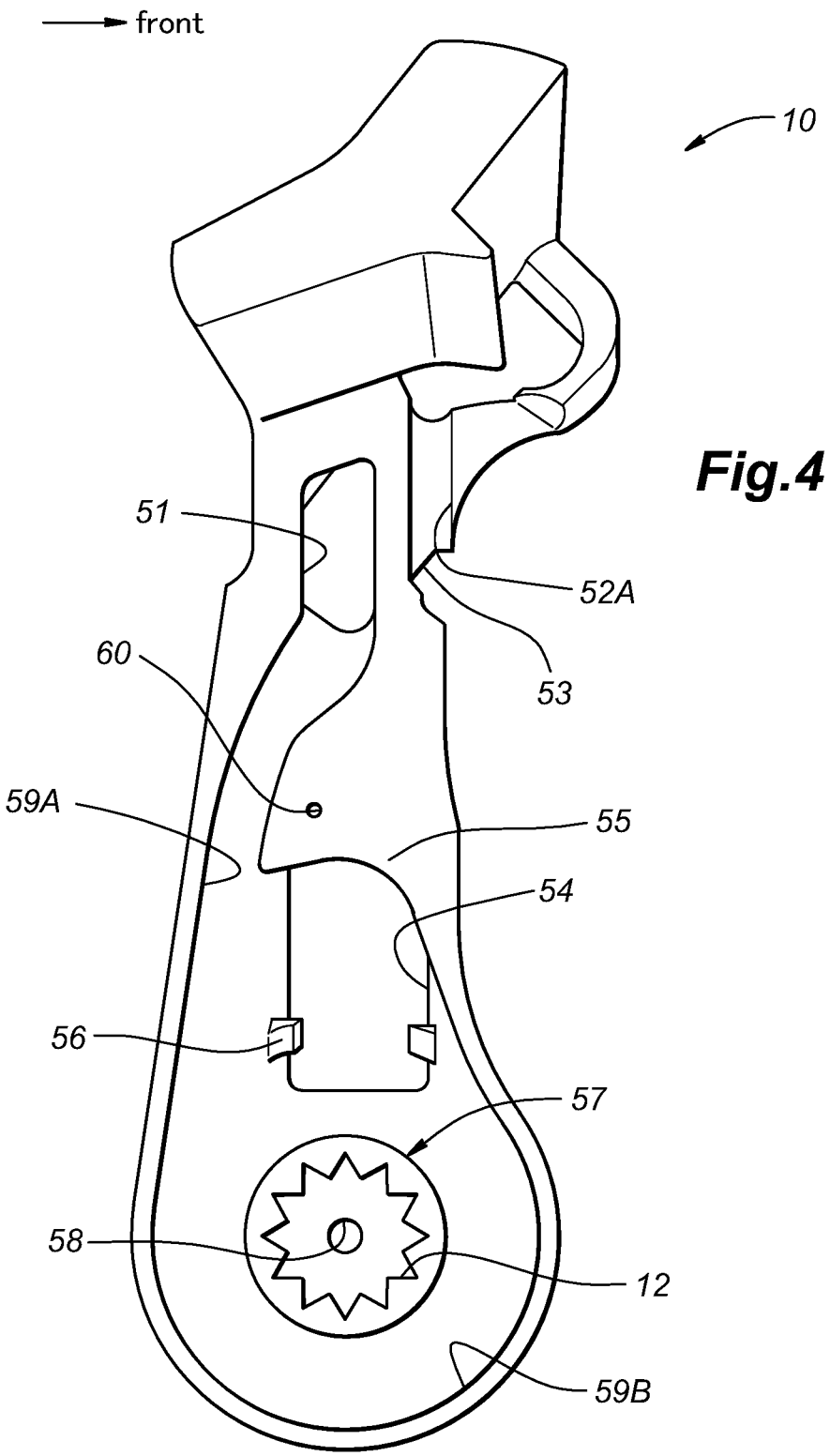
FIG. 4 is a right side view of the lever with the outer cover thereof removed.
Figure 5:
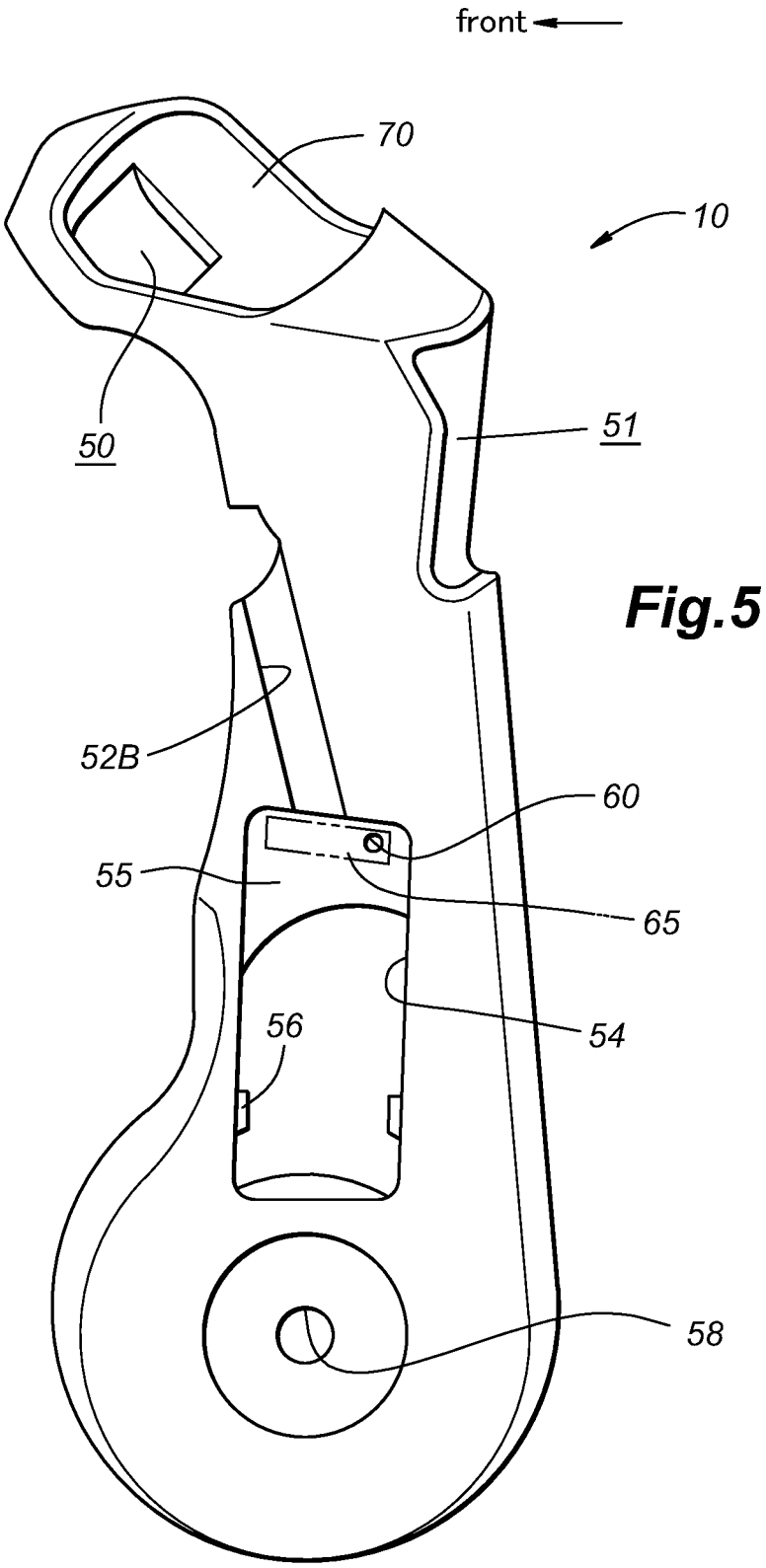
FIG. 5 is a left side view of the lever with the outer cover thereof removed.

The lever 7 includes a lever main body 10 provided with various functional structures and a lever cover 11 (FIG. 2) that covers the lever main body 10 to improve its external appearance. FIGS. 4 and 5 show the lever main body 10 with the lever cover omitted. A recess 70 is provided at the upper end of the lever main body 10, and the recess 70 is closed by a part of the lever cover 11 forming the palm rest 16. An opening 50 extending to the recess 70 is provided in a lower front end part of the grip 8 to receive the lock release button 14. A vertically elongated hole 51 for positioning the trim switch 15 is provided in a rear part of the upper end of the lever main body 10. A wire receiving groove 59A is provided on the right side of the lever main body 10 along and adjacent to the rear side of the lever main body 10, and an annular groove 59B communicating with the wire receiving groove 59A is provided on the outer periphery of the cylindrical collar 57 projecting rightward around the serration hole 12, for receiving electric wire connected to the trim switch 15 therein.

A rod receiving groove 52 for receiving the rod 21 is formed in the lever main body 10. More specifically, a first groove 52A that extends vertically and opens rightward is provided in an upper front part of the lever main body 10 slightly below the grip 8. Under the first groove 52A is provided a notch 53 that extend laterally through the lever main body 10. The lower end of the notch 53 communicates with an upper end of a second groove 52B which extends substantially vertically while tilting backward so as to be continuous with the first groove 52A, and opens rightward. The lower end of the second groove 52B communicates with a window hole 54 provided in the lever main body 10. The window hole 54 is substantially rectangular, and the upper part of the window hole 54 is closed by a bottom plate 55 to define a recess facing rightward, and the rest of the window hole 54 extends laterally through the lever main body 10.

The serration hole 12 and the collar 57 are coaxial with the pivot axis of the lever 7. The serration hole 12 is fitted onto a serration shaft (not shown in the drawings) for remote control operation provided on the remote controller main body 5. After the serration shaft is fitted into the serration hole 12, a fixing screw (not shown in the drawings) is screwed into a screw hole (not shown in the drawings) provided in the serration shaft via an opening 58 provided at the center of the collar 57 with the result that the lever main body 10 is attached to the remote controller main body 5 side.

Figure 6:
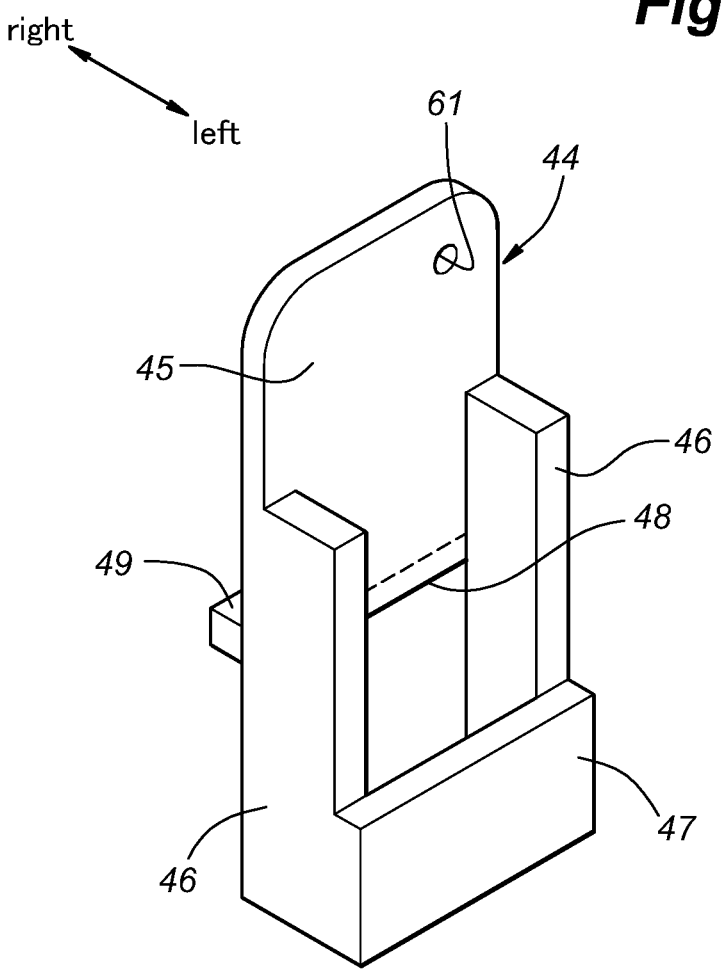
FIG. 6 is a perspective view of a guide lock member.

FIG. 6 shows a lock guide member 44 for guiding the movement of the lock member 31. The lock guide member 44 consists of a back plate 45, a pair of side plates 46 extending orthogonally from either side edge of the back plate 45 (to the left with respect to the lever 7), and a front plate 47 connecting the free ends of the side plates 46 to each other. The lower edges of the front plate 47 and the side plates 46 are substantially horizontal and coplanar. Since the lower edge of the back plate 45 is positioned higher than the upper edge of the front plate 47, an insertion hole 48 opening rearward is provided in the lower part of the back plate 45. In other words, the upper edge of the insertion hole 48 is defined by the lower edge of the back plate 45 and positioned above the upper edge of the front plate 47 by a predetermined distance. A projecting piece 49 projects like an eave from a part of the back plate 45 corresponding to the upper edge of the insertion hole 48 in a direction facing away from the front plate 47 (or rightward with respect to the lever 7). The vertical length of the front plate 47 is longer than the distance which the lock member 31 travels between the lock position and the release position as will be described later.

As shown in FIGS. 4 and 5, a pair of claws 56 projecting from either side edge of the window hole 54 toward each other in a lower part of the window hole 54. The lock guide member 44 is fitted into the window hole 54 of the lever main body 10 from the left. At this time, the lock guide member 44 is inserted into the window hole 54 in such a manner that the back plate 45 is positioned on the front side, and the rear surface of the front plate 47 is substantially flush or continuous with the part of the lever main body 10 surrounding the window hole 54. A round hole 61 is formed in the back plate 45, and the lock guide member 44 is fixed to the bottom plate 55 by screwing a tapping screw into a fitting hole 60 provided in the bottom plate 55 through the round hole 61. The lock guide member 44 has a substantially same shape as the window hole 54 and is fitted therein with relatively small clearance. Also, the insertion depth of the lock guide member 44 in the window hole 54 is defined by the claws 56 and the back plate 45. Therefore, the lock guide member 44 can be stably attached to the lever main body 10 with only one tapping screw. At this time, the projecting piece 49 projects rightward from the lever main body 10.

Figure 7:
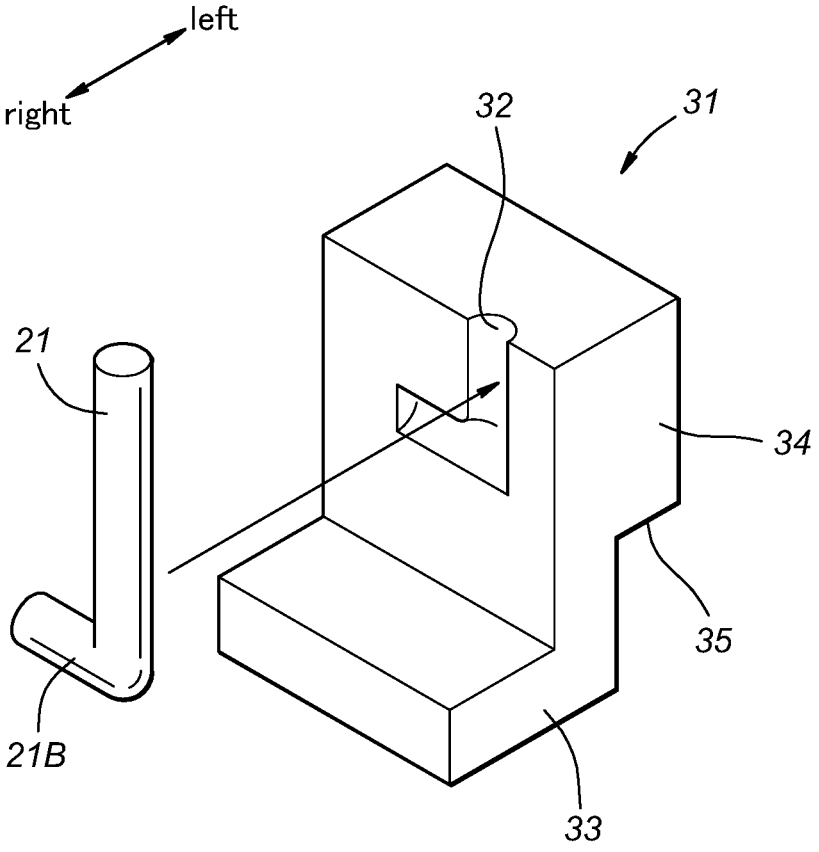
FIG. 7 is a perspective view of a lock member.

As shown in FIG. 7, the lock member 31 has a rectangular plate-like main body and an engagement piece 33 extending from the lower end thereof in a direction substantially orthogonal to the major plane thereof (leftward with respect to the lever 7). Therefore, the lock member 31 has an L shape when viewed from the side. An L-shaped receiving groove 32 reaching the upper edge of the main body of the lock member 31 is formed on the surface of the main body on the same side as the engagement piece 33. An upper part of the main body of the lock member 31 is formed as a thick wall portion 34 in such a manner that a downwardly facing shoulder surface 35 is defined at a position slightly above the lower edge of the main body of the lock member 31.

Figure 8A:
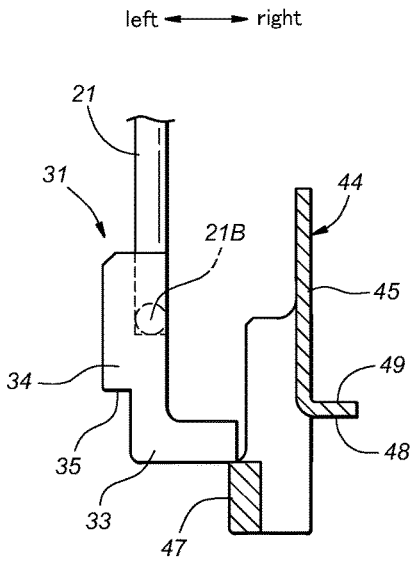
FIGS. 8A to 8C are diagrams illustrating the procedure to assembling the lock member to the lock guide member.
Figure 8B:
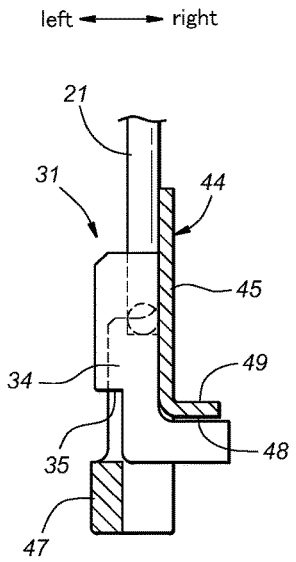
Figure 8C:
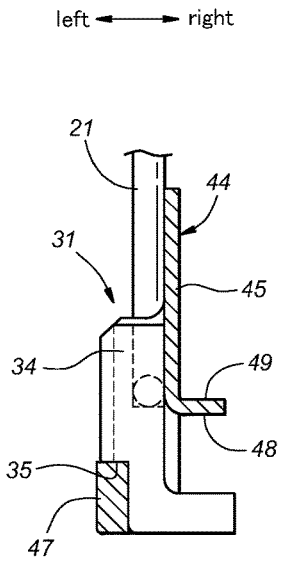

Next, the procedure for assembling the lock member 31 and the parts associated therewith will be described in the following. First of all, as shown in FIG. 7, the second end 21B of the rod 21 is bent sideways so that it can be fitted into the receiving groove 32 of the lock member 31 with relatively little clearance. As shown in FIG. 8, with the second end 21B received in the receiving groove 32, the lower end of the engagement piece 33 of the lock member 31 is moved along the upper edge of the front plate 47 and toward the back plate 45. Then, the projecting piece 49 is passed into the insertion hole 48 and the front surface of the main body of the lock member 31 comes into contact with the opposing surface of the back plate 45. As a result, the lower part of the lock member 31 passes the front plate 47, and the lock member 31 can be displaced downward until the upper edge of the front plate 47 comes into contact with the shoulder surface 35 on the lock member 31.

As shown in FIG. 9, the rod 21 includes a rod upper end part 62 extending substantially vertically downward from the first end 21A, a rod intermediate part 63 extending obliquely downward and rearward from the lower end thereof, and a rod lower end part 64 extending substantially vertically downward from the lower end of the rod intermediate part 63 and connected to the lock member 31. As shown in FIGS. 3, 4 and 5, the rod upper end part 62 is received in the first groove 52A provided in the lever main body 10 and opening rightward with respect to the lever main body 10, and passes downward through the notch 53. The rod intermediate part 63 is generally received in the second groove 52B provided in the lever main body 10 and opening leftward with respect to the lever main body 10. The second groove 52B has a larger width than the first groove 52A, and is formed wide enough to allow the rod intermediate part 63 to move vertically. The rod lower end part 64 is located generally within the window hole 54. The upper part of the rod lower end part 64 is held in the second groove 52B by a guide piece 65 indicated by an imaginary line in FIG. 5 (from the left side with respect to the lever main body 10) so as to be movable in the vertical direction. The guide piece 65 is jointly fastened by the tapping screw that fixes the lock guide member 44 to the lever main body 10.

When assembled in this manner, the second end 21B of the rod 21 is received in the receiving groove 32 of the main body of the lock member 31, and the front surface (right side in FIG. 8) of the main body of the lock member 31 is laid upon the opposing surface of the back plate 45 while the rod 21 is held on the lever main body 10 by the guide piece 65, and the main body of the lock member 31 is retained by the back plate 45, the side plates 46, and the front plate 47 of the lock guide member 44. Therefore, even though the assembly work is facilitated, the lock member 31 is securely retained by the lock guide member 44 so that the lock member 31 is prevented from being dislodged from the lock guide member 44 during use or during the assembly process. As a result, the material cost is reduced and the assembly process is simplified.

The holder 22 includes a pair of flanges 22A arranged laterally one next to each other, and each having a plate-like shape extending orthogonally to the pivot axis of the lever 7 and configured to be attached to a part of the hull, and an arcuate member 22B extending between the flanges 22A with a convex side facing upward. An engagement slot 23 is provided in a middle or upper part of the arcuate member 22B to receive the lock member 31 with a relatively tight fit.

Figure 9A:
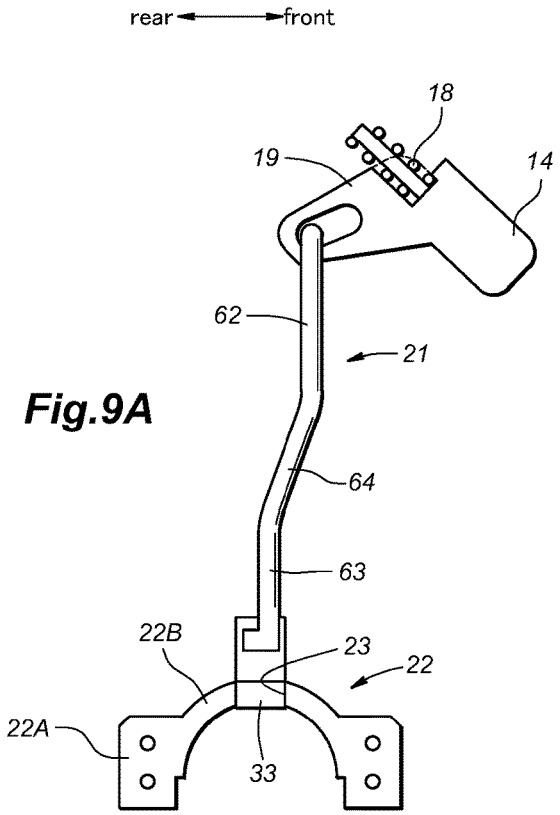
FIGS. 9A and 9B are diagrams illustrating the mode of operation of the lock member and the lock guide member.

Next, the mode of operation of the lever 7 will be described in the following. First, when the lever 7 is in the neutral position, as shown in FIG. 9A, the lock release button 14 is in the projecting position under the biasing force of the compression coil spring 18, and owing to the interaction between the slot 20 and the first end 21A of the rod 21, the rod 21 is in the lowered position and the lock member 31 is in the lock position in engagement with the engagement slot 23. Therefore, tilting of the lever 7 is prohibited. The lower limit position of the lock member 31, or the lock position is defined by abutting of the shoulder surface 35 of the lock member 31 onto the upper edge of the front plate 47 of the lock guide member 44.

Figure 9B:
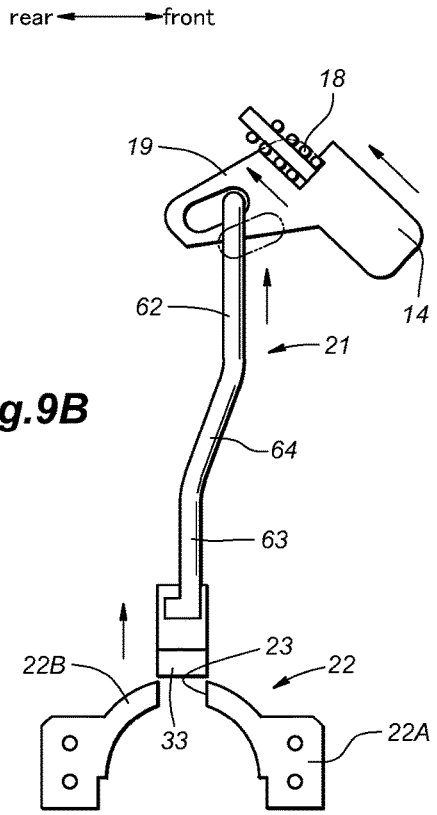

When the user wants to tilt the lever 7 from the neutral position to the forward tilted position, or the forward position, the user depresses the lock release button 14. The displacement of the lock release button 14 in the retracting direction is transmitted to the cam plate 19, causing a displacement of the cam plate 19 having upward and rearward components of as shown in FIG. 9B. As a result, the first end 21A of the rod 21 is pulled upward by the lower edge of the slot 20 due to the upward displacement component of the cam plate 19, and the rearward displacement component of the cam plate 19 causes the first end 21A of the rod 21 to climb the slope defined by the lower edge of the slot 20 and thereby moves upward. Thus, the obliquely upward displacement of the lock release button 14 is converted into the upward displacement of the rod 21.

In this way, when the lock release button 14 is retracted obliquely upward to the rear, the lock member 31 is pulled up via the rod 21 and takes the release position where the lock member 31 is moved away from the holder 22 with the result that the lever 7 can be tilted to a forward tilted position or forward position. At this time, the upper limit position of the lock member 31, or the release position, is defined by the upper surface of the engagement piece 33 coming into contact with the upper edge of the insertion hole 48.

When the lever 7 is in the forward position, the biasing force of the compression coil spring 18 acts on the lock member 31 via the rod 21, and the lock member 31 is in contact with the upper surface of the arcuate member 22B. When the lever 7 is returned to the neutral position from this state, the lock member 31 is pushed into the engagement slot 23 of the holder 22 under the biasing force of the compression coil spring 18, and the lever 7 occupies and is held at the neutral position. Tilting the lever 7 to the reverse position can be performed in a similar manner as tilting the lever 7 to the forward position.

Although not shown in the drawings, the electric wire connected to the trim switch 15 extends to the lower annular groove 59B via the wire receiving groove 59A, and is wound around the outer circumference of the collar 57 before reaching the remote controller main body 5. Therefore, even when the rod 21 is vertically displaced, the wiring wire does not interfere with the rod 21, and even if the lever 7 is tilted forward or backward, the stress applied to the electric wire is minimized so that the durability of the electric wire can be increased.

In the above embodiment, the conversion mechanism for converting the operation direction of the lock release button 14 containing upward and rearward components into the vertical movement of the rod 21 made use of an interaction between a cam plate 19 formed with a slot 20 and a cam pin formed by the first end 21A of a rod 21. By appropriately selecting the extending direction of the slot 20, the operating direction of the unlock button 14 can be selected so that the freedom in the arrangement of the lock release button 14 can be increased.

The conversion mechanism may also consist of a cam mechanism of a different configuration, a bell crank mechanism or any other per se known mechanism, and the purview of the present invention extends to such variations. In the above embodiment, the grip 8 extended rightward, but the present invention is equally applicable to the case where the grip 8 extends leftward by converting the structures discussed above into a mirror image thereof.

According to the embodiment described above, since the operating direction of the lock release button can be tilted with respect to the vertical direction, the lock release button can be ergonomically favorably positioned so that the operability of the lock release button is improved. Further, if the lock release button is provided in a lower part of the grip at an obliquely forward position, and the first direction is an oblique direction intermediate between downward and forward directions, the lock release button is positioned behind the grip as viewed from the user so that the lock release button is concealed from the view of the user. Therefore, the aesthetic appearance of the entire lever can be improved.

The rod 21 includes a rod upper end part 62 extending substantially vertically downward from the first end 21A, a rod intermediate part 64 extending obliquely downward from the lower end thereof with a rearward slant, and a rod lower end part 63 extending downward from the lower end of the rod intermediate part 64 and connected to the locking member 31. As a result, the lock release button 14 can be positioned in an ergonomically favorable position, or in a lower part of the free end part of the lever 7 with a forward slant so that and the locking member 31 can be comfortably operated.

As shown in FIG. 6, the lock member 31 is assembled to the lock guide member 44 in such a manner that the engaging piece 33 projects toward the insertion hole 48, and the plate-like main body of the lock guide member 44 abuts against the opposing surface of the lock member 31, and guided by the back plate 45, the side plates 46, and the front plate 47 for a prescribed vertical movement. As a result, the lock member 31 can be stably displaced between the lock position and the release position because the fore and aft and lateral displacements of the lock member 31 are favorably restricted.

As shown in FIGS. 4 and 5, a recess 70 is provided at the upper end of the lever main body 10, and the recess 70 is closed by the part of the lever cover 11 forming the palm rest 16. An opening 50 communicating with the recess 70 is provided in the lower front end of the grip 8 to receive the lock release button 14 therein. As a result, a space for receiving the lock release button 14 can be secured, and the required strength of the lever 7 can be ensured in a reliable manner. Also, the lever cover 11 can improve the external appearance of the lever 7. The palm rest 16 can comfortably support the user's hand when operating the boat, particularly by setting the forward tilting state of the lever 7 so as to correspond to the operating position, particularly the forward position. Therefore, the operability of the lever 7 is improved.

The lever main body 10 is provided with a first groove 52A, a notch 53, and a second groove 52B for receiving the rod 21. This arrangement allows the decrease in rigidity of the lever body 10 to be minimized. Further, the second groove 52B that receives the rod intermediate part 64 is provided wider than the first groove 52A that receives the rod upper end portion 62 so that, when the rod intermediate part 64 which is inclined with respect to the vertical direction is displaced in the vertical direction, the rod intermediate part 64 is not interfered by the lever main body 10.

The present invention has been described in terms of a specific embodiment, but the present invention is not limited by such an embodiment and can be modified in various ways without departing from the scope of the present invention. Moreover, not all of the constituent elements shown in the above embodiments are essential to the broad concept of the present invention, and they can be appropriately selected, omitted and substituted without departing from the gist of the present invention.

For instance, although the remote controller 4 was installed on the console 2 in the foregoing embodiment, it may be installed on the side wall of the hull 1. Also, the holder 22 may be formed with a plurality of engagement slots 23 so that the tilting of the lever 7 can be restricted even at the operating position (forward position, for instance).

The contents of any cited references in this disclosure will be incorporated in the present application by reference.

The invention claimed is:

1. A remote controller for watercraft, comprising:

a remote controller main body configured to be fixed to a hull, a holder fixedly attached to the remote controller main body, a lever having a base end part pivotally attached to the remote controller main body and a free end part, the lever being tiltable between in an upright initial position and a tilted operating position;

a lock member provided in the base end part of the lever so as to be movable between a lock position for engaging with the holder to prohibit tilting of the lever and a release position for releasing the holder;

a rod extending downward from the free end part of the lever along a lengthwise direction of the lever, and having a first end positioned in the free end part and a second end connected to the lock member;

a lock release button slidably provided in the free end part so as to be slidable in a first direction different from the lengthwise direction of the lever; and a conversion mechanism provided between the lock release button and the first end of the rod to covert a movement of the lock release button in the first direction to a movement of the rod in a second direction extending along the lengthwise direction of the lever.

2. The remote controller according to claim 1, wherein the free end part of the lever has a laterally extending grip, and the lock release button is provided in an obliquely forward position on a lower part of the grip, the first direction being an oblique direction intermediate between downward and forward directions.

3. The remote controller according to claim 2, wherein the conversion mechanism consists of a slot cam mechanism which includes a cam member provided integrally with the lock release button, a cam slot formed in the cam member so as to extend in a third direction different from the first direction and the second direction, and a cam pin provided on the first end of the rod so as to engage the slot.

4. The remote controller according to claim 2, wherein the lever includes a lever main body and a lever cover that covers the lever main body, and the lever main body is provided with a recess in an upper end thereof, an opening provided at an obliquely front part of the grip for receiving the lock release button therein, a serration hole provided in a lower end thereof to be fitted on a serration shaft provided on a side of the remote controller main body, and a window hole for mounting the lock guide member therein.

5. The remote controller according to claim 4, wherein the lever cover includes a palm rest portion that covers the recess from above, and defines an outer surface that slopes upward toward a front when the lever is at the initial position.

6. The remote controller according to claim 4, wherein the rod includes a rod upper end part extending substantially vertically downward from the first end of the rod, a rod intermediate part extending downward from a lower end of the rod upper end part with a rearward slant, and a rod lower end part extending substantially downward from a lower end of the rod intermediate part toward the second end of the rod with a rearward offset relative to the rod upper end part.

7. The remote controller according to claim 6, wherein the lever main body is provided with a rod receiving groove extending on a side surface of the lever main body to receive the rod therein.

8. The remote controller according to claim 7, wherein the rod receiving groove includes a first groove opened toward a side corresponding to an extending direction of the grip to receive the rod upper end part therein, and a second groove opened toward a side opposite to the side corresponding to the extending direction of the grip to receive at least most of the rod intermediate part therein, and the lever main body is provided with a notch passed laterally through between the first groove and the second groove so as to receive a lower part of the rod upper end part and/or an upper part of the rod intermediate part.

9. The remote controller according to claim 8, wherein the second groove is substantially wider than the first groove.

10. The remote controller according to claim 4, wherein a trim switch for receiving a trim up/down operation is provided on a rear side of the upper end part of the lever, and the lever main body is provided with a wire receiving groove provided on one side thereof to receive an electric wire connected to the trim switch and an annular groove provided around the serration hole so as to communicate with the wire receiving groove.

11. The remote controller according to claim 1, wherein the lever main body includes a lock guide member that guides displacement of the lock member in the second direction.

12. The remote controller according to claim 11, wherein the lock member includes a main body made of a plate member, and an engagement piece extending substantially orthogonally to a major plane of the main body so as to engage with an engagement slot of the holder in the lock position, and the lock guide member includes a back plate having a sliding surface slidable on a surface of the main body of the lock member on a side of the engaging piece thereof, a pair of slide plates projecting from either side edge of the back plate so as to slidably guide side edges of the main body, and a front plate extending between free ends of the side plates and having a sliding surface slidable with a surface of the main body of the lock member facing away from the engagement piece thereof, a lower edge of the back plate being higher than an upper edge of the front plate by a distance slightly greater than a vertical direction of the engagement piece.

13. The remote controller according to claim 12, wherein an upper portion of the main body of the engaging piece includes a thick wall portion to define a shoulder surface facing downward, and the lock position is defined by abutting of the shoulder surface against an upper surface of the front plate of the lock guide member.

* * * * *